US007145136B2

(12) United States Patent
Yang et al.

(10) Patent No.: US 7,145,136 B2
(45) Date of Patent: Dec. 5, 2006

(54) ATMOSPHERIC PRESSURE IONIZATION WITH OPTIMIZED DRYING GAS FLOW

(75) Inventors: Zicheng Yang, Alameda, CA (US); Roger C. Tong, Berkeley, CA (US)

(73) Assignee: Varian, Inc., Palo Alto, CA (US)

( * ) Notice: Subject to any disclaimer, the term of this patent is extended or adjusted under 35 U.S.C. 154(b) by 154 days.

(21) Appl. No.: 11/015,235

(22) Filed: Dec. 17, 2004

(65) Prior Publication Data

US 2006/0131497 A1 Jun. 22, 2006

(51) Int. Cl.
*H01J 49/10* (2006.01)

(52) U.S. Cl. ..... 250/288; 250/423 R; 250/425

(58) Field of Classification Search ..... 250/288, 250/423 R, 424, 425
See application file for complete search history.

(56) References Cited

U.S. PATENT DOCUMENTS

| | | | | |
|---|---|---|---|---|
| 4,121,099 | A | 10/1978 | French et al. | |
| 4,209,696 | A | 6/1980 | Fite | |
| 4,531,056 | A | 7/1985 | Labowsky et al. | |
| 4,542,293 | A | 9/1985 | Fenn et al. | |
| 4,861,988 | A | 8/1989 | Henion et al. | |
| 4,935,624 | A | 6/1990 | Henion et al. | |
| 5,412,208 | A | 5/1995 | Covey et al. | |
| 5,736,741 | A * | 4/1998 | Bertsch et al. | 250/288 |
| 6,177,669 | B1 | 1/2001 | Wells et al. | |
| 6,410,914 | B1 * | 6/2002 | Park et al. | 250/288 |
| 6,586,732 | B1 | 7/2003 | Lee et al. | |
| 6,593,568 | B1 | 7/2003 | Whitehouse et al. | |
| 6,653,626 | B1 | 11/2003 | Fischer et al. | |
| 6,759,650 | B1 | 7/2004 | Covey et al. | |
| 6,794,646 | B1 | 9/2004 | Tong et al. | |

FOREIGN PATENT DOCUMENTS

| | | |
|---|---|---|
| WO | WO 02/082073 A2 | 10/2002 |
| WO | WO 02/082073 A3 | 10/2002 |

* cited by examiner

*Primary Examiner*—Kiet T. Nguyen
(74) *Attorney, Agent, or Firm*—Bella Fishman; David Gloekler

(57) ABSTRACT

An apparatus for use in atmospheric pressure ionization includes a sample receiving chamber, a sample droplet source communicating with the sample receiving chamber, an outlet conduit, and a boundary. The outlet conduit defines a sampling orifice that communicates with the sample receiving chamber. The boundary is interposed between the sample receiving chamber and the sampling orifice and comprises an opening. The opening defines a first passage through which a drying gas is flowable into the sample receiving chamber in an elongated flow profile, and a second passage through which sample material is flowable from the sample receiving chamber toward the sampling orifice. The first passage is positioned in non-coaxial relation to the second passage. The first passage is configured to introduce the elongated flow profile of the drying gas into a pathway of droplets of the sample material flowing toward the second passage.

18 Claims, 9 Drawing Sheets

ATMOSPHERIC PRESSURE IONIZATION WITH OPTIMIZED DRYING GAS FLOW

FIELD OF THE INVENTION

The present invention relates generally to atmospheric pressure ionization. More particularly, the present invention relates to providing a flow of drying gas into an apparatus for atmospheric pressure ionization in an optimized manner so as to improve the performance of the apparatus.

BACKGROUND OF THE INVENTION

Certain techniques, such as in analytical chemistry, require that components of a sample be ionized prior to analysis. Mass spectrometry (MS) is an example of such analytical techniques. Generally, MS describes a variety of instrumental methods of qualitative and quantitative analysis that enable sample components to be resolved according to their mass-to-charge ratios. For this purpose, an MS system converts the components of a sample into ions, sorts or separates the ions based on their mass-to-charge ratios, and processes the resulting ion output (e.g., ion current, flux, beam, etc.) as needed to produce a mass spectrum. Typically, a mass spectrum is a series of peaks indicative of the relative abundances of charged components as a function of mass-to-charge ratio (typically expressed as m/z or m/e, or simply "mass" given that the charge z or e often has a value of 1).

Insofar as the present disclosure is concerned, MS systems are generally known and need not be described in detail. Briefly, a typical MS system generally includes a sample inlet system, an ion source or ionization system, a mass analyzer (also termed a mass sorter or mass separator) or multiple mass analyzers, an ion detector, a signal processor, and readout/display means. Additionally, the MS system may include an electronic controller such as a computer or other electronic processor-based device for controlling the functions of one or more components of the MS system, storing information produced by the MS system, providing libraries of molecular data useful for analysis, and the like. The electronic controller may include a main computer that includes a terminal, console or the like for enabling interface with an operator of the MS system, as well as one or more modules or units that have dedicated functions such as data acquisition and manipulation. The MS system also may include a vacuum system to enclose the mass analyzer(s) in a controlled, evacuated environment. In addition to the mass analyzer(s), depending on design, all or part of the sample inlet system, ion source, and ion detector may also be enclosed in the evacuated environment. Certain types of ion sources or interfaces operate at or near atmospheric pressure and thus are distinct from the vacuum or low-pressure regions of the mass analyzer.

In operation, the sample inlet system introduces a small amount of sample material into the ion source. Depending on design, all or part of the sample inlet system may be integrated with the ion source. In hyphenated techniques, the sample inlet system may be the output of an analytical separation instrument such as a gas chromatographic (GC) instrument, a liquid chromatographic (LC) instrument, a capillary electrophoresis (CE) instrument, a capillary electrochromatography (CEC) instrument, or the like. The ion source converts components of the sample material into a stream of positive and negative ions. One ion polarity is then accelerated into the mass analyzer. The mass analyzer separates the ions according to their respective mass-to-charge ratios. The mass-resolved ions outputted from the mass analyzer are collected at the ion detector. The ion detector is a type of transducer that converts ion current to electrical current, thereby encoding the information represented by the ion output as electrical signals to enable data processing by analog and/or digital techniques.

Several different approaches may be taken for effecting ionization. Hence, various designs for ion sources have been developed. The present disclosure relates primarily to a class of ionizing techniques known as atmospheric pressure ionization (API) in which ionization of sample material occurs at or near atmospheric pressure, after which time the resulting ions are transferred to the mass spectrometer. For convenience, the term "mass spectrometer" is used herein in a general, non-limiting sense to refer to a mass analyzing/sorting device and any associated components typically operating within an evacuated space that receives an input of sample material from the API interface. Examples of API techniques include electrospray ionization (ESI), atmospheric pressure chemical ionization (APCI or APcI), and atmospheric pressure photoionization (APPI). API techniques are particularly useful when it is desired to couple mass spectrometry with an analytical separation technique such as liquid chromatography (LC), including high-performance liquid chromatography (HPLC). For instance, the output or effluent from an LC column can serve as the sample source or input into an API interface. Typically, the effluent consists of a liquid-phase matrix of analytes (for example, molecules of interest) and mobile-phase material (for example, solvents and additives).

ESI is a type of desorption ionization technique in which energy is applied to a sample liquid so as to cause direct formation of gaseous ions. A typical ESI source includes a chamber held at atmospheric pressure (or near atmospheric pressure). This chamber is separated from one or more vacuum or low-pressure regions of the mass spectrometer in which the mass analyzing and ion detection components reside. Sample liquid is introduced into the chamber through a capillary tube or electrospray needle. A voltage potential is applied between the electrospray needle and a counter-electrode that may be a surface or other structure within the chamber, thereby establishing an electric field within the chamber. The electric field induces charge accumulation at the surface of the liquid at or near the tip of the electrospray needle, and the liquid is discharged from the needle in the form of highly charged droplets (electrospray). The breaking of the stream of liquid into a mass of fine droplets, or aerosol, may be assisted by a nebulizing technique that may involve pneumatic, ultrasonic, or thermal means. For example, pneumatic nebulization may be implemented by providing a tube coaxial to the electrospray needle and discharging an inert gas such as nitrogen coaxially with the sample liquid. An electric field directs the charged droplets from the tip of the electrospray needle toward a sampling orifice that leads from the chamber to the mass spectrometer. The droplets undergo a process of desolvation or ion evaporation as they travel through the chamber and/or through a conduit associated with the sampling orifice. As solvent contained in the droplets evaporates, the droplets become smaller. In addition, the droplets may rupture and divide into even smaller droplets as a result of repelling coulombic forces approaching the cohesion forces of the droplets. Eventually, charged analyte molecules (analyte ions) desorb from the surfaces of the droplets. Ideally, only the analyte ions enter the mass spectrometer, and not the other components of the electrospray such as neutral solvated droplets. A stream of an inert drying gas such as nitrogen may be introduced into the chamber to assist in the evaporation of solvent and/or sweep the solvent away from the sampling orifice. The drying gas may be heated prior to introduction into the chamber. Conventionally, the drying gas is introduced through an annular opening formed by a tube that is coaxial with the sampling orifice. That is, the drying gas is introduced coaxially and in counterflow relation to the electrospray as the electrospray approaches the sampling orifice. Alternatively, the drying gas is introduced as a curtain in front of the sampling orifice.

Unlike ESI, APCI is a type of gas-phase ionization technique that requires nebulization and vaporization of the sample liquid prior to ionization. It will be noted, however, that some commercially available API sources are readily interchangeable between ESI and APCI modes of operation, and in analytical practice these two modes can be complementary and thus highly useful. Like the ESI source, a typical APCI source includes an atmospheric-pressure chamber separated from the mass spectrometer. Sample liquid is introduced into a pneumatic nebulizer in which an inert nebulizing gas such as nitrogen, flowing concentrically with the stream of sample liquid, breaks the liquid stream into droplets. The sample droplets then flow through a heated vaporization chamber or tube to vaporize the mobile phase and other components of the droplet matrix. The resulting gas-phase droplet dispersion is then discharged into the chamber. An electrode such as a corona discharge needle extends into the chamber and emits electrons. As a result, a corona discharge is generated in the chamber. The corona discharge ionizes the mobile-phase molecules to form an energetic, chemical-reagent gas plasma. In the corona discharge, ion-molecule reactions occur between the charge-neutral sample and the reagent ions formed in the primary discharge. The ion-molecule reactions in turn cause the sample components to become charged, and the resulting analyte ions are directed toward a sampling orifice that leads from the chamber to the mass spectrometer. A voltage potential may be impressed between, for example, the corona discharge needle and a counter-electrode such as a plate surrounding the sampling orifice to guide the analyte ions toward the sampling orifice. Similar to the above-described ESI source, a flow of drying gas may be introduced coaxially and in counterflow relation to the analyte ion flux as the flux approaches the sampling orifice, or introduced as a curtain in front of the sampling orifice, to prevent entry of neutral droplets into the mass spectrometer.

In the APPI technique, similar to APCI, sample liquid flows through a nebulizer, the resulting droplets flow through a vaporizer, and the resulting vaporized droplet matrix is introduced into an atmospheric-pressure chamber. The droplets are then irradiated by photons emitted from a photon source such as an ultraviolet (UV) lamp or other suitable device. The photon source may be positioned near the exit orifice of the vaporizer from which the droplets are introduced into the chamber, or integrated with the vaporizer, or otherwise positioned to ensure that the path of the photons will encounter the path of the droplets. The droplet matrix is ionized through collisions between the photons and the components of the matrix. As in other techniques, an electric field may be established in the chamber to guide the ions toward the sampling orifice. In addition, a counterflow of drying gas coaxial with the sampling orifice that leads to the mass spectrometer, or alternatively a curtain of drying gas, may be utilized to prevent entry of unwanted droplets into the mass spectrometer.

A recurring problem in API techniques such as those described above is the entry of unwanted droplets and other non-analytical material into the sampling orifice. Such unwanted components may degrade the performance of the mass spectrometer and/or the quality of the mass spectral data produced thereby, through contamination, reduction in sensitivity, reduction in robustness, peak tailing, et cetera. These problems can be exacerbated as the flow rate of sample material introduced into the ion source is increased. As previously noted, the ion source has conventionally been provided with a counterflow or a curtain of a heated, dry inert gas such as nitrogen to protect the sampling orifice by blowing away the unwanted components. These previous approaches, however, have failed to sufficiently appreciate that the entry of unwanted components into the sampling orifice may be enhanced by increasing or promoting the transfer of heat energy from the drying gas to the droplets in the chamber to thereby increase evaporation. While the flow rate and temperature of drying gas could be varied for this purpose, and often is varied to accommodate different mobile-phase compositions, the ranges over which these parameters can be varied is limited in practice. The flow rate of the drying gas cannot be so great as to prevent the analyte ions from entering the sampling orifice. Moreover, the temperature of the drying gas cannot be so great as to thermally degrade the analyte ions, or to otherwise adversely affect the analyte ions or impair the performance of the mass spectrometer.

Accordingly, there continues to be a need for improving evaporation of droplets in an ion source, and for protecting the mass spectrometer or other analytical instrument to which the ion source is coupled from the droplets, in order to improve the performance of the analytical instrument and the quality of the data produced thereby, such as by increasing sensitivity, reducing noise, and reducing contamination. The present disclosure recognizes that a flow of drying gas into an appropriately designed ion source can establish a heated zone or area in which heat energy is transferred from the drying gas to the sample material in the ion source. In conventionally designed ion sources, the flow of drying gas is focused only at the region immediately in front of the sampling orifice, and primarily as a single, concentrated flow path. Consequently, the heated zone in which the drying gas can encounter sample material is too small and, consequently, limits the process of evaporation.

SUMMARY OF THE INVENTION

To address the foregoing problems, in whole or in part, and/or other problems that may have been observed by persons skilled in the art, the present disclosure provides apparatus and methods for atmospheric pressure ionization (API), as described by way of exemplary implementations set forth below.

According to one implementation, an apparatus for use in atmospheric pressure ionization is provided. The apparatus comprises a sample receiving chamber, a sample droplet source communicating with the sample receiving chamber, an outlet conduit, and a boundary. The outlet conduit defines a sampling orifice that communicates with the sample receiving chamber. The boundary is interposed between the sample receiving chamber and the sampling orifice and comprises an opening. The opening defines a first passage through which a drying gas is flowable into the sample receiving chamber in an elongated flow profile, and a second passage through which sample material is flowable from the sample receiving chamber toward the sampling orifice. The first passage is positioned in non-coaxial relation to the second passage. The first passage is configured to introduce the elongated flow profile of the drying gas into a pathway of droplets of the sample material flowing toward the second passage.

According to other implementations, the sample droplet source may comprise an electrospray ionization source, a chemical ionization source, or a photoionization source.

According to another implementation, the sampling orifice communicates with an analytical instrument, such as a mass analyzer and/or an ion detector.

According to another implementation, the opening of the boundary comprises a single aperture that defines both the first and second passages.

According to another implementation, the opening of the boundary comprises at least a first aperture and separate second aperture. The first aperture defines the first passage and the second aperture defines the second passage.

According to other implementations, a portion of a single-aperture opening defining the first passage, or the first aperture of a multi-aperture opening defining the first passage, is elongated in at least one direction.

According to another implementation, an apparatus for use in atmospheric pressure ionization is provided. The apparatus comprises a sample receiving chamber, a sample droplet source communicating with the sample receiving chamber, and an outlet conduit defining a sampling orifice that communicates with the sample receiving chamber. The apparatus further comprises means for directing a flow of drying gas into the chamber according to an elongated flow profile and in a non-coaxial, generally counterflow relation to a flow of droplets from the sample droplet source, whereby the elongated flow profile presents an elongated area at which the sample droplets contact the drying gas for evaporating the droplets.

In another aspect, a method is provided for evaporating droplets of sample material in an atmospheric pressure ionization apparatus. According to the method, sample material is admitted into a chamber as a sample droplet stream. The sample droplet stream is directed toward an opening and a sampling orifice. The chamber and sampling orifice are positioned at opposite sides of the opening and the sampling orifice leads away from the chamber. While directing the sample droplet stream, a flow of drying gas is admitted through the opening and into the chamber in a non-coaxial, generally counterflow relation to the sample droplet stream and according to an elongated flow profile, whereby the elongated flow profile presents an elongated area in which droplets of the sample droplet stream contact the drying gas for enhancing evaporation of the droplets prior to entry of sample material into the sampling orifice.

DETAILED DESCRIPTION OF THE INVENTION

In general, the term "communicate" (for example, a first component "communicates with" or "is in communication with" a second component) is used herein to indicate a structural, functional, mechanical, electrical, optical, magnetic, ionic or fluidic relationship between two or more components or elements. As such, the fact that one component is said to communicate with a second component is not intended to exclude the possibility that additional components may be present between, and/or operatively associated or engaged with, the first and second components.

The subject matter disclosed herein generally relates to atmospheric pressure ionization (API). Examples of implementations of apparatus, systems, devices, and/or related methods for API are described in more detail below with reference to FIGS. 1–5H. These examples are described in the context of mass spectrometry. However, any process in which the production of ions is desired, including the use of analytical instruments other than mass spectrometers, may fall within the scope of this disclosure.

Figure 1:
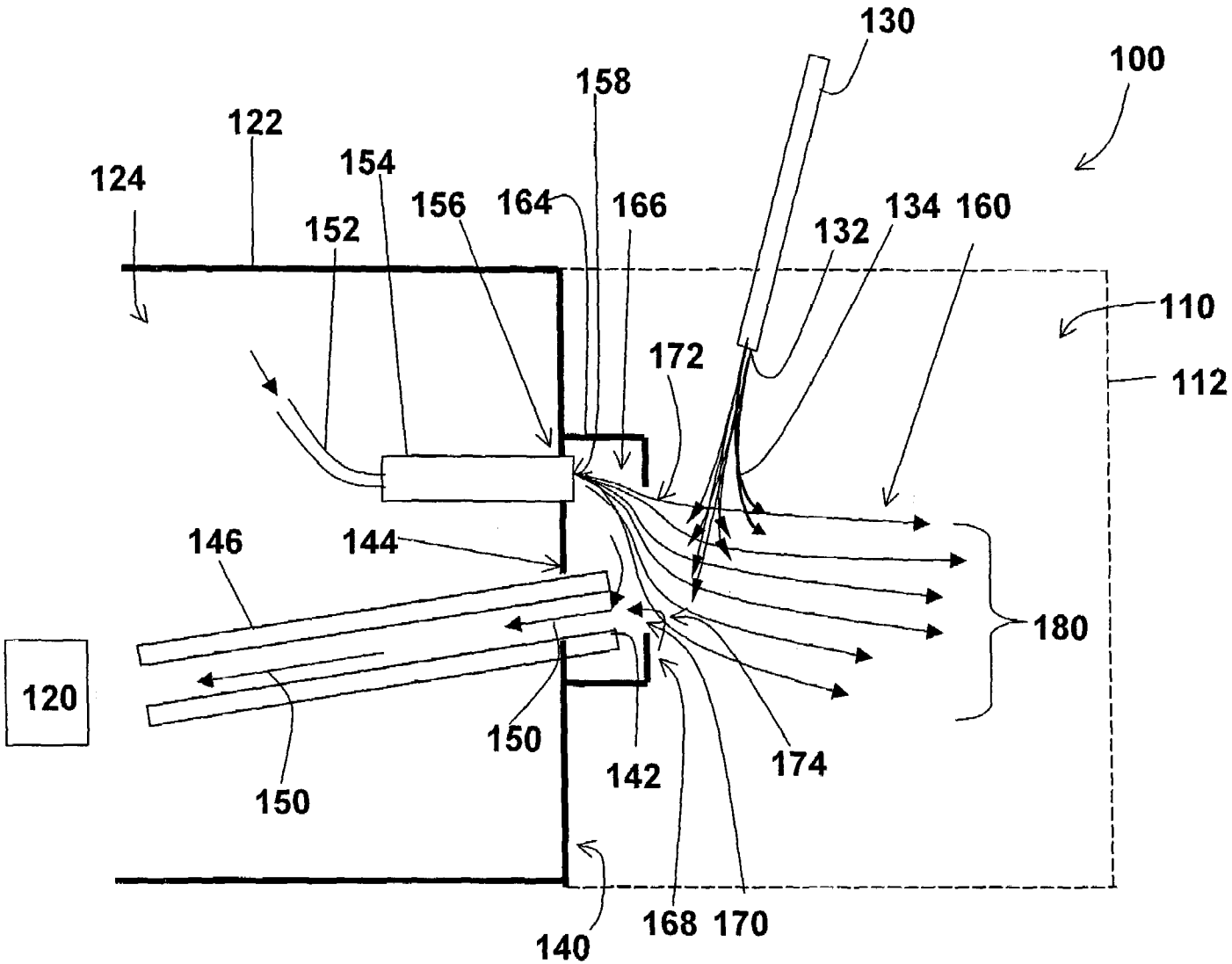
FIG. 1 is a schematic view of a cross-section of an apparatus for use in atmospheric pressure ionization (an API apparatus) according to an exemplary implementation.

FIG. 1 is a schematic view of a cross-section of an apparatus 100 for use in API according to an exemplary implementation. A sample receiving chamber 110 may be defined by a suitable housing or other structure 112. The interior of chamber 110 is typically held at or near atmospheric pressure. Chamber 110 thus provides a region in which full or partial ionization of a sample material occurs at or near atmospheric pressure as part of a desired analytical procedure, particularly in preparation for detecting analyte ions by a suitable analytical instrument such as a mass spectrometer 120. A housing 122 adjacent to chamber 110 may be employed to enclose an evacuated or low-pressure environment or interior 124 in which ion focusing, mass analyzing and ion detection components (not shown) operate. For convenience, the components operating within housing 122 will collectively be referred to as a mass spectrometer 120. As appreciated by persons skilled in the art, housing 122 may enclose one or more distinct vacuum stages (not specifically shown), or regions held at different pressure levels, in which one or more of the various components of mass spectrometer 120 are contained.

A sample droplet source 130 extends into chamber 110 such that an exit orifice 132 of sample droplet source 130 fluidly communicates with chamber 110. As appreciated by persons skilled in the art, the type of sample droplet source 130 employed in apparatus 100 may vary in accordance with the API technique being implemented. For example, in the case of ESI, sample droplet source 130 may comprise an electrospray device such as an electrospray needle. The electrospray device may include a capillary, needle, or other small tube through which sample material flows. The electrospray device may be capable of providing assisted nebulization of the sample material. For instance, in the case of pneumatic nebulization, the electrospray needle may be surrounded by an outer tube to define an annular passage through which an inert nebulizing gas such as nitrogen flows. In the case of APCI or APPI, sample droplet source 130 may comprise a capillary, needle, or other small tube through which sample material flows, and which is integrated with or communicates with a vaporizing device. The vaporizing device may be integrated with or follow a nebulizing device. In all such cases, sample material is emitted from exit orifice 132 of sample droplet source 130 as a stream or jet of vapor or gas (or electrospray in the case of ESI), which for convenience will be referred to as a sample droplet stream 134 regardless of form or composition.

For purposes of the present disclosure, no limitation is placed on the composition of the sample material, the manner in which the sample material is provided to sample droplet source 130, or fluid dynamic parameters such as flow rate, pressure, viscosity, and the like. In a typical implementation, the sample material provided to sample droplet source 130 is predominantly a fluid but in other implementations may be a solid or a multi-phase mixture. In many implementations involving API, the fluid is predominantly in a liquid phase. For example, the sample material may be a solution in which analyte components (for example, molecules of interest) are initially dissolved in one or more solvents or carried by other types of components. In addition to solvents, other non-analytical components (that is, components for which analysis is not desired and/or input into the analytical instrument is typically not desired) may be present, such as excipients, buffers, additives, dopants, or the like. As another example, the sample material may be the eluent from a chromatographic, electrophoretic or other analytical separation process, in which case the sample material may be a matrix composed of analyte and mobile-phase components. Depending on the location of a given portion of sample material in apparatus 100 or the procedural stage at which ionization is occurring, the sample material may comprise primarily ions alone or ions in combination with other components such as charged and/or neutral droplets, vapor, gas, or the like. Accordingly, the term "sample material" as used herein is not limited by any particular phase, form, or composition. Moreover, the sample material flowing through sample droplet source 130 may originate from any suitable source or sample inlet system (not shown), such as a batch volume, a sample probe, or an upstream instrument or process. For example, the inlet into sample droplet source 130 may comprise or communicate with the outlet of an analytical separation system or device such as a chromatographic column. As other examples, the sample material may be supplied to sample droplet source 130 from a liquid handling system or a dissolution testing system. The flow of the sample material to or through sample droplet source 130 may be induced by any means, such as pumping, capillary action, or electrically-related techniques.

A front structure or end plate 140 of housing 122 generally separates the atmospheric-pressure chamber 110 from the evacuated interior 124 of housing 122. Front structure 140 may comprise one or more structural components, fastening components, sealing components, and the like. A sampling orifice 142 is defined by an opening 144 of front structure 140, or by a capillary, tube, or other outlet conduit 146 for ions that registers with or extends through opening 144 of front structure 140 into chamber 110. That is, sampling orifice 142 may be disposed at or near front structure 140, and provides fluid communication between chamber 110 and interior 124 of housing 122. Sampling orifice 142 has a small bore that is not so large as to defeat the pressure differential maintained between chamber 110 and housing interior 124. Sampling orifice 142 serves as the inlet for a stream of analyte ions 150 traveling from chamber 110 into housing 122, after which the ions of ion stream 150 may be guided to mass spectrometer 120 via appropriate means such as lenses (not shown). In a typical implementation, exit orifice 132 of sample droplet source 130 is aimed generally toward sampling orifice 142. As shown by example in FIG. 1, the axis of exit orifice 132 of sample droplet source 130 may be angled or offset relative to the axis of sampling orifice 142.

Figure 2:
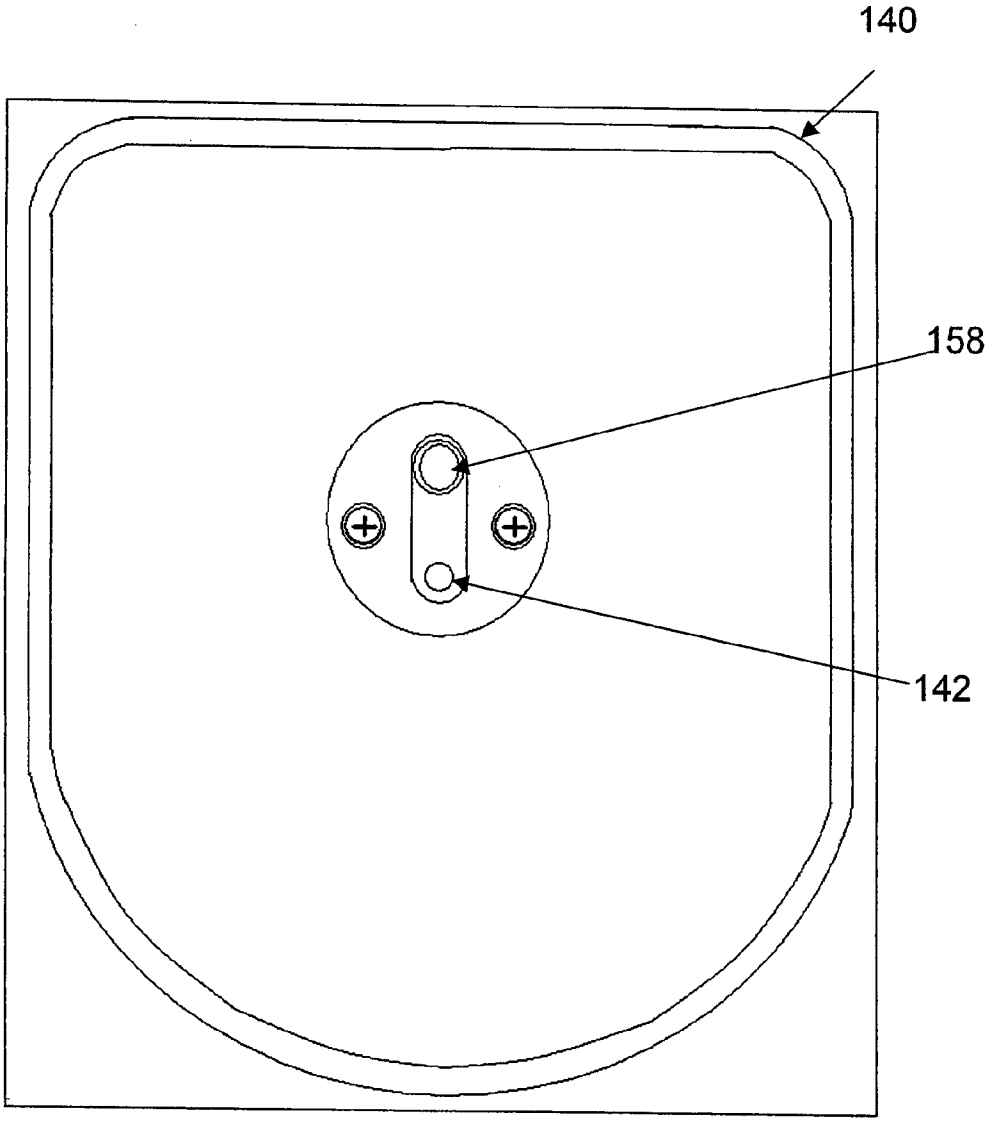
FIG. 2 is a front elevation view of a structure provided with the API apparatus, illustrating a drying gas outlet orifice and a sampling orifice.

Apparatus 100 further includes a drying gas delivery system. The drying gas delivery system may include a drying gas conduit 152 for delivering a flow of a suitable inert drying gas such as nitrogen to chamber 110 from any suitable drying gas source (not shown), and a heating device 154 for transferring heat energy to the drying gas. Heating device 154 may be positioned at any location that results in the drying gas being sufficiently heated as the drying gas is introduced into chamber 110. In the exemplary implementation shown in FIG. 1, heating device 154 is positioned in-line with drying gas conduit 152. Drying gas conduit 152, or both drying gas conduit 152 and heating device 154, may be mounted in an opening 156 of front structure 140 of housing 122. A drying gas outlet orifice 158 of the drying gas delivery system registers with or extends through opening 156 of front structure 140 into chamber 110. Drying gas outlet orifice 158 is positioned in non-coaxial relation to sampling orifice 142 such that the axis of drying gas outlet orifice 158 is spaced at a distance from the axis of sampling orifice 142. Accordingly, a drying gas stream 160 is directed into chamber 110 in a generally counterflow relation to ion stream 150 entering sampling orifice 142. That is, in the vicinity of front structure 140 of housing 122, drying gas stream 160 flows generally parallel to, but in an opposite direction to, ion stream 150 entering sampling orifice 142. FIG. 2 illustrates a front view of front structure 140 and shows the position of drying gas outlet orifice 158 relative to sampling orifice 142 according to the exemplary embodiment. As appreciated by persons skilled in the art, the drying gas delivery system may also include means for varying the temperature and flow or pressure of the drying gas in accordance with operating parameters (for example, the composition or volatility of a mobile phase that forms a part of the sample droplet matrix discharged from sample droplet source 130, the flow rate of the sample droplet matrix, et cetera).

Referring again to FIG. 1, apparatus 100 further includes a structural boundary 164 interposed between housing 122 and chamber 110. More specifically, drying gas outlet orifice 158 and sampling orifice 142 are located on one side of boundary 164 and chamber 110 is located on the other side of boundary 164. Boundary 164 defines an interfacial space 166 between drying gas outlet orifice 158 and sampling orifice 142 on the one side and chamber 110 on the other side. For this purpose, boundary 164 may be a component integral with front structure 140 of housing 122 or a separate component attached to front structure 140. Moreover, the structure comprising boundary 164 may include one or more portions, such as walls, surfaces, shoulders, and the like. In the example illustrated in FIG. 1, boundary 164 is shown in cross-section as having a box-like shape. In the illustrated implementation, boundary 164 includes a wall or front plate 168 spaced from front structure 140 of housing 122. Interfacial space 166 may or may not be considered as being a part of chamber 110. In either case, interfacial space 166 generally has the same pressure as chamber 110 but is distinct from chamber 110 due to the presence of boundary 164.

Boundary 164 defines a boundary opening 170 that provides fluid communication between interfacial space 166 and chamber 110. In the exemplary implementation illustrated in FIG. 1, front plate 168 of boundary 164 defines boundary opening 170. Boundary opening 170 is located relative to drying gas outlet orifice 158 and sampling orifice 142 so as to provide at least two opening portions: a first passage or pathway 172 and a second passage or pathway 174. First passage 172 (or the portion of opening 170 defining first passage 172) is adjacent to and spaced from second passage 174 (or the portion of opening 170 defining second passage 174), and is disposed in non-coaxial relation to second passage 174. Drying gas stream 160 flows from drying gas outlet orifice 158, through first passage 172, and into chamber 110. At the same time, ion stream 150 flows from chamber 110, through second passage 174, and into sampling orifice 142, generally in parallel, opposite relation to drying gas stream 160. First passage 172 is generally fluidly distinct from second passage 174 in the sense that drying gas stream 160 is generally separate from ion stream 150 immediately in opening 170, due to the flow rate of drying gas stream 160, and/or due to the configuration of opening 170 and its position relative to other components of apparatus 100. In some exemplary implementations, first passage 172 is also structurally distinct from second passage 174. That is, as described further below, in some implementations boundary opening 170 is defined by a single aperture for which the respective portions of opening 170 defining first passage 172 and second passage 174 are adjoined, while in other implementations boundary opening 170 is defined by more than one aperture such that one or more apertures define first passage 172 and one or more other apertures define second passage 174. In particularly advantageous implementations, boundary 164 or at least front plate 168 of boundary 164 (in either case, the portion of boundary 164 defining boundary opening 170) is spaced far enough from front structure 140 of housing 122 to allow drying gas stream 160 emitted from drying gas outlet orifice 158 to begin to expand. In this case, the size of first passage 172 may be greater than the size of second passage 174 over the direction along which first passage 172 and second passage 174 are situated relative to each other. Accordingly, from the perspective of FIG. 1, the length (or width) of first passage 172 along the vertical direction may be greater than the length (or width) of second passage 174 along the same direction.

As a result of the configuration of boundary opening 170, drying gas stream 160 passes through first passage 172 of boundary opening 170 into chamber 110 with an elongated flow profile 180. In other words, the flow profile is expanded predominantly along at least one direction or dimension. In the exemplary embodiment illustrated in FIG. 1, the flow profile of drying gas stream 160 is elongated generally in a vertical direction as generally indicated at 180. Elongated flow profile 180 presents an expanded or enlarged heating zone as compared to conventional ion sources, thereby providing an opportunity to take full advantage of the ability of the drying gas to evaporate solvent and other non-analytical components of sample droplet stream 134. The enlarged heating zone may be utilized to increase the rate of evaporation of components of sample droplet stream 134 by increasing the amount of overlap or contact between sample droplet stream 134 and drying gas stream 160, thereby increasing the rate of heat transfer from the drying gas to the sample droplets and the total amount of heat energy transferred. To further optimize the evaporative process, sample droplet source 130 or at least its exit orifice 132 may be oriented such that sample droplet stream 134 encounters the entire or most of the elongated dimension 180 of drying gas stream 160 in a generally cross-flow relation. For example, sample droplet stream 134 may come into contact with drying gas stream 160 along an orthogonal or substantially orthogonal direction as shown in FIG. 1. The orientation of exit orifice 132 relative to elongated drying gas profile 180 may be such that evaporation of droplets begins shortly after the droplets are formed, and such that evaporation continues over substantially the entire path of sample droplet stream 134 through chamber 110. By the time sample droplet stream 134 passes through the elongated flow profile 180 of drying gas stream 160, all or most non-analytical components of sample droplet stream 134 will have been evaporated and/or swept away by drying gas stream 160 such that only analyte ions enter sampling orifice 142 as indicated by ion stream 150.

Figure 3:
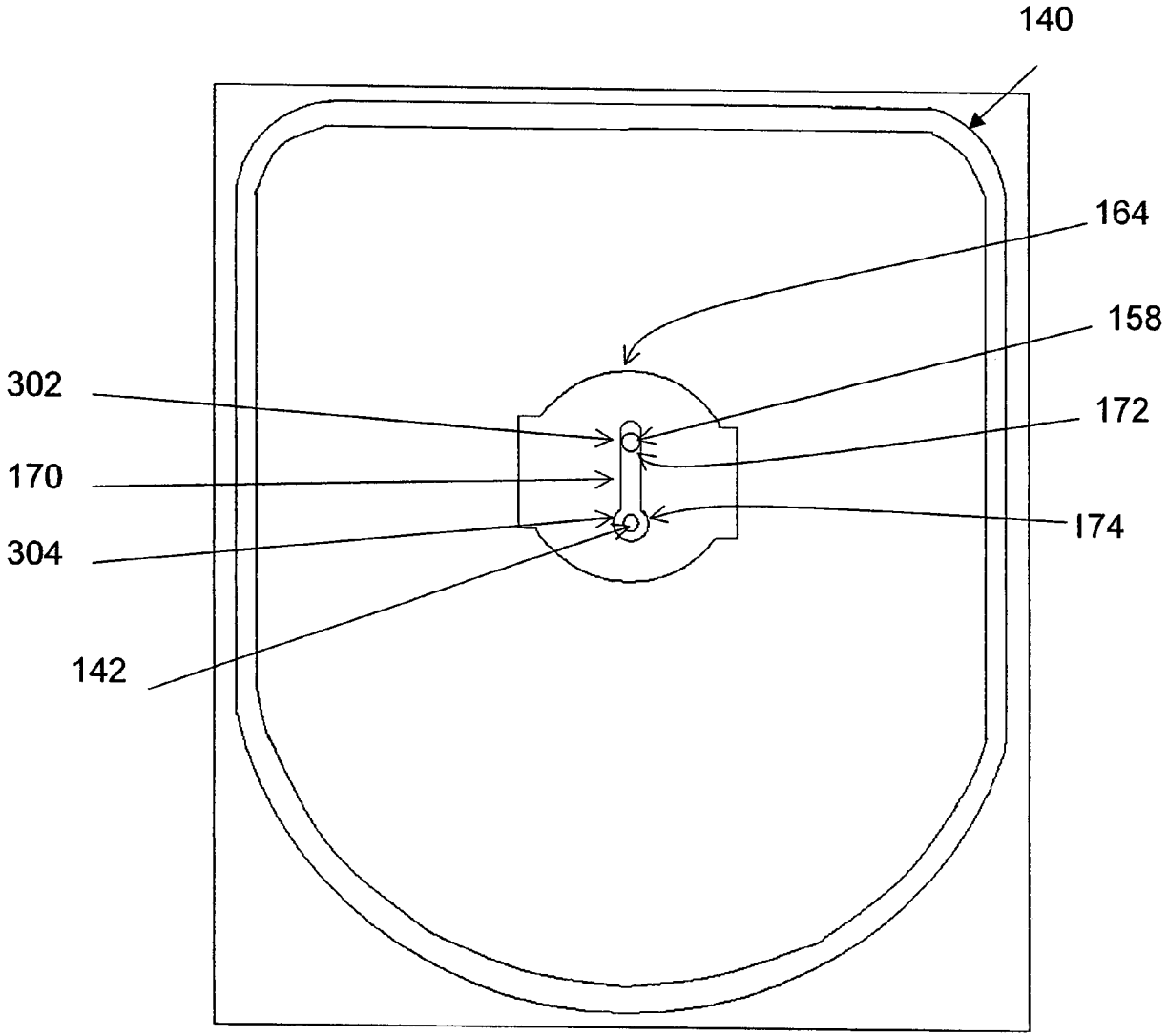
FIG. 3 is a front elevation view of the structure shown in FIG. 2, illustrating a boundary or front plate with an opening, and which is positioned in front of the drying gas outlet orifice and sampling orifice according to an exemplary implementation.

FIG. 3 is a front elevation view of front structure 140 of housing 122 (FIG. 1), illustrating an exemplary implementation in which front plate 168, as part of boundary 164, is positioned in front of drying gas outlet orifice 158 and sampling orifice 142. In this example, boundary opening 170 of front plate 168 has a single-aperture design, but the shape of this aperture may be characterized as defining a first section 302 and an adjoined second section 304. First section 302 is generally fluidly aligned with drying gas outlet orifice 158 and generally defines first passage 172 through which drying gas passes from drying gas outlet orifice 158 into chamber 110 (FIG. 1). Second section 304 is generally fluidly aligned with sampling orifice 142 and generally defines second passage 174 through which analyte ions 150 pass from chamber 110 into sampling orifice 142. The fluid dynamics engendered by front plate 168 may be further visualized by referring to FIG. 4, which, similar to FIG. 1, illustrates flow vectors schematically representing drying gas stream 160, sample droplet stream 134, and ion stream 150. As compared with second section 304 of opening 170, first section 302 is elongated in at least one direction or dimension (in the present example, a vertical direction) to enable the profile of drying gas stream 160 to become elongated in the same direction (i.e., elongated drying gas flow profile 180). In the example illustrated in FIG. 4, second section 304 has a generally circular cross-section or shape to facilitate the input of ions into sampling orifice 142, although other shapes may be employed. Second section 304 may be wider than first section 302 along another dimension (for example, horizontally).

Ideally, by the time a given portion of sample droplet stream 134 has passed through the elongated section 180 of drying gas stream 160, full evaporation of the droplets in that portion has occurred, such that only ions of analytical value enter sampling orifice 142. Front plate 168 according to the exemplary implementations disclosed herein is designed to attain or at least approach this result. By contrast, conventional ion sources do not provide a structure such as front plate 168 that is configured to provide a first section 302 or define a first passage 172 for drying gas. As previously indicated, in some conventional ion sources, a flow of drying gas is introduced coaxially about sampling orifice 142 and hence is focused primarily into a single flow path immediately in front of sampling orifice 142. In other conventional ion sources, the flow of drying gas is introduced into chamber 110 from the chamber-side of the ion source, whether or not the ion source is equipped with a spray plate or similar structure. Such a design relies on fluid mechanics to divert sample droplets against the solid section of the spray plate or other similar structure, or otherwise away from sampling orifice 142. None of the conventional designs establishes a heating zone large enough to take full advantage of the potential of drying gas to sufficiently evaporate non-analytical material and prevent such material from entering sampling orifice 142.

FIGS. 5A–5H illustrate additional examples of implementations of front plate 168. Like front plate 168 shown in FIGS. 3 and 4, FIGS. 5A–5C illustrate a front plate 168 that defines a boundary opening 170 of single-aperture design. FIGS. 5D–5H illustrate a front plate 168 that defines a boundary opening 170 of multiple-aperture design. Each of the front plates 168 shown in FIGS. 5A–5H, provided as part of boundary 164 described above in conjunction with FIG. 1, can engender the fluid dynamics in chamber 110 that produce an elongated flow profile 180 for drying gas stream 160 and, consequently, an enlarged heating zone in chamber 110 for sample droplet stream 134 and the attendant advantages and benefits discussed above. The selection among differently configured front plates 168 to achieve the desired results may depend on one or more factors, such as the properties (for example, composition, volatility, molecular weight, viscosity, whether polar or non-polar, et cetera) and/or operating parameters (flow rate, pressure, et cetera) of one or more components of the sample material, the operating parameters of the drying gas (flow rate, pressure, temperature, whether such parameters are to be varied during ionization, et cetera).

Figure 5A:
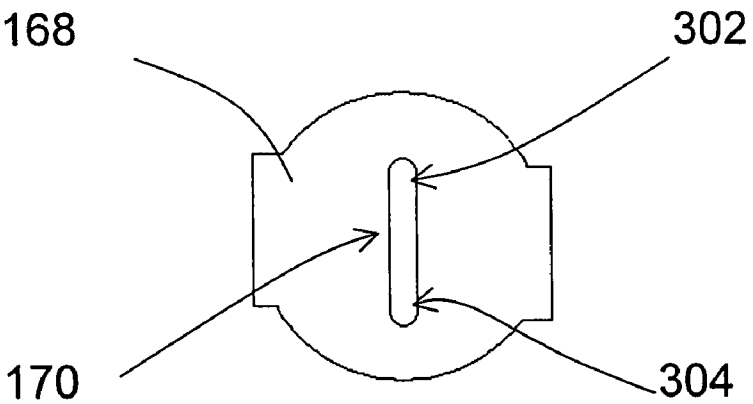
FIGS. 5A–5H are respective front elevation views of variously configured front plates according to additional exemplary implementations.

In FIG. 5A, boundary opening 170 of front plate 168 is generally shaped a slot or aperture that is elongated in one direction (for example, a vertical direction). The width of first section 302 of boundary opening 170 along another direction (for example, a horizontal direction) may be the same as the width of second section 304.

Figure 5B:
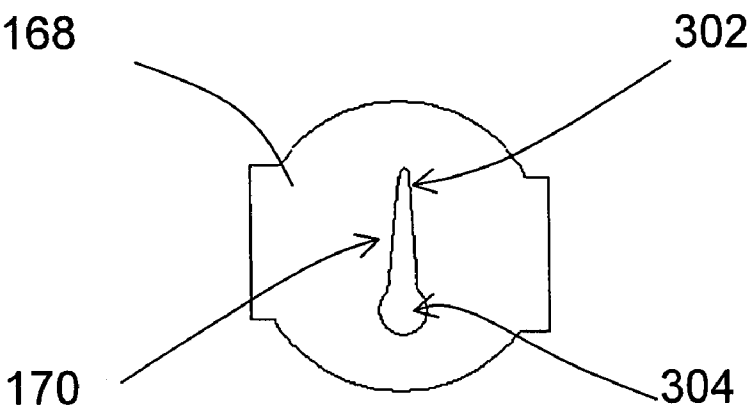

In FIG. 5B, first section 302 of boundary opening 170 of front plate 168 is elongated in one direction. The width of first section 302 tapers along the direction in which first section 302 is elongated. Second section 304 may have any suitable shape. In the example given by FIG. 5B, second section 304 is generally circular.

Figure 5C:
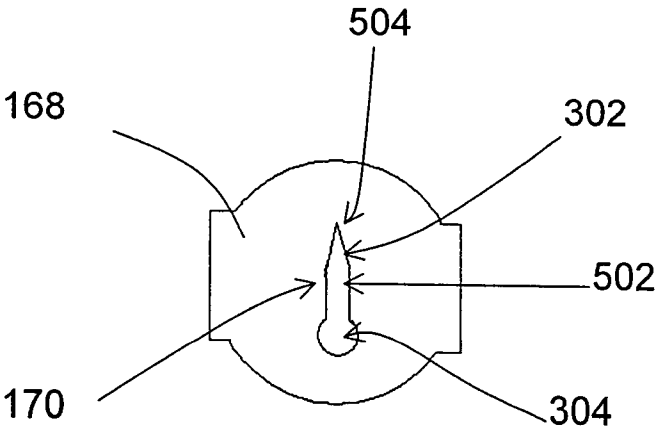

In FIG. 5C, boundary opening 170 of front plate 168 is similar to that shown in FIG. 5B. In FIG. 5C, however, a portion 502 of first section 302 has a constant or substantially constant width, while another portion 504 of first section 302 has a tapered width. Second section 304 may have a generally circular shape, but any other suitable shape may be provided in this implementation.

Figure 4:
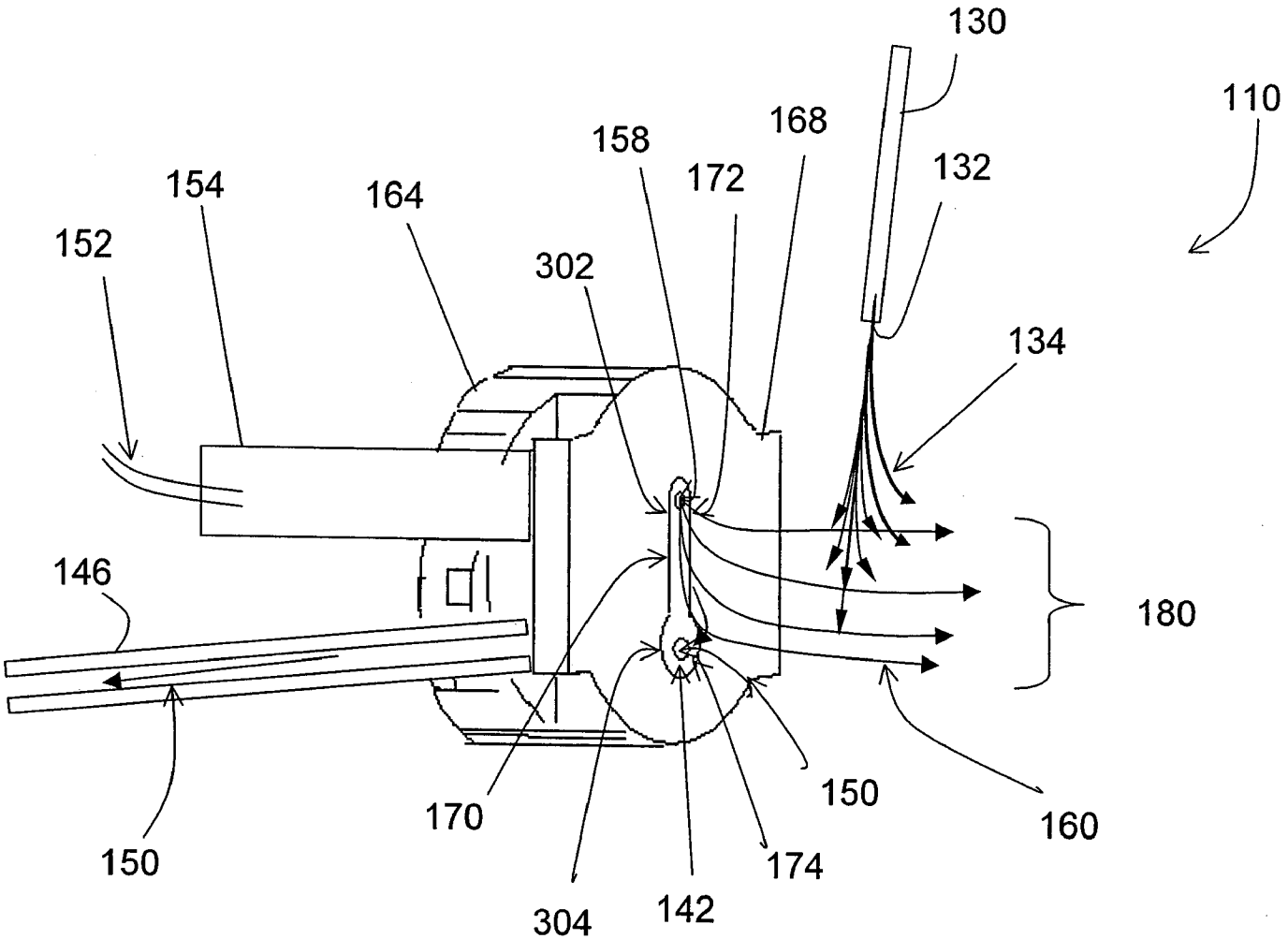
FIG. 4 is a perspective view of the boundary or front plate shown in FIG. 3 in relation to other components of an API apparatus according to an exemplary implementation.
Figure 5D:
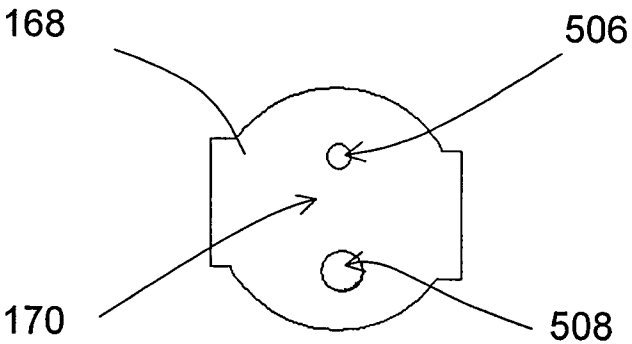

In FIG. 5D, boundary opening 170 of front plate 168 is configured as a first aperture 506 and a physically distinct second aperture 508. First aperture 506 defines the first passage 172 (FIGS. 1 and 4) for drying gas and second aperture 508 defines the second passage 174 for ions. First aperture 506 is spaced from second aperture 508 by a distance sufficient to enable the flow of drying gas to expand and form an elongated flow profile (see, for example, elongated drying gas flow profile 180 shown in FIGS. 1 and 4), and thus the enlarged heating zone, in a region of chamber 110 where sample droplets encounter the drying gas. In the example shown in FIG. 5D, first aperture 506 and second aperture 508 are linearly positioned relative to each other, i.e., along the same direction, but this is not a limitation of this particular implementation or any other implementation described herein. Also in the example shown in FIG. 5D, first aperture 506 and second aperture 508 are generally circular in shape. However, other shapes may be provided, and the shape of first aperture 506 may be different than the shape of second aperture 508. Moreover, the diameter of first aperture 506 (or the magnitude of some other characteristic dimension, if non-circular) is shown by way of example as being smaller than the diameter of second aperture 508. However, the diameter of first aperture 506 may be the same as or greater than the diameter of second aperture 508.

Figure 5E:
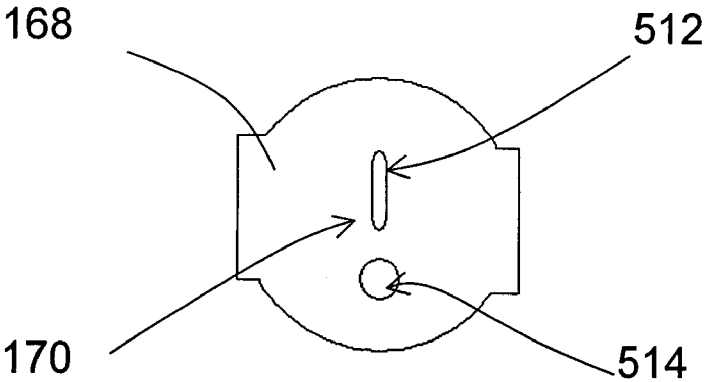

In FIG. 5E, boundary opening 170 of front plate 168 is configured as a first aperture 512 and a physically distinct second aperture 514. Similar to FIG. 5D, first aperture 512 defines the first passage 172 (FIGS. 1 and 4) for drying gas and second aperture 514 defines the second passage 174 for ions. In FIG. 5E, however, first aperture 512 is generally shaped a slot that is elongated in one direction. Second aperture 514 is generally circular in shape, but may have a different shape. In the example shown in FIG. 5D, the width of first aperture 512 is smaller than the width (for example, diameter) of second aperture 514. However, in other implementations, the width of first aperture 512 may be the same as or greater than the width of second aperture 514.

Figure 5F:
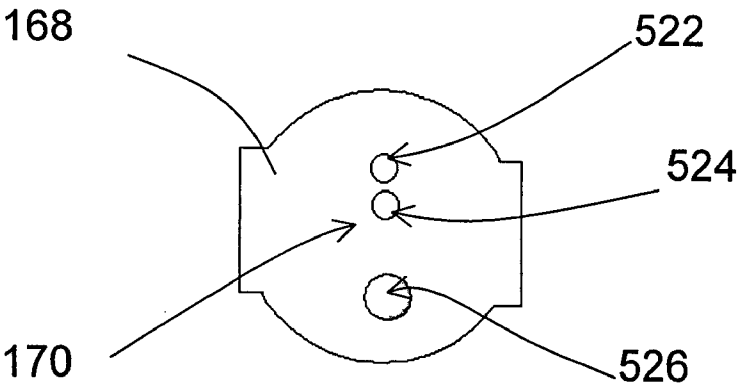

In FIG. 5F, boundary opening 170 of front plate 168 is defined by three separate apertures, a first aperture 522, a second aperture 524, and a third aperture 526. First aperture 522 and second aperture 524 cooperatively define the first passage 172 (FIGS. 1 and 4) for drying gas and third aperture 526 defines the second passage 174 for ions. First aperture 522 and second aperture 524 are spaced or grouped relatively close together, but are spaced farther from third aperture 526 by a distance sufficient to form the above-described elongated drying gas flow profile 180 (FIGS. 1 and 4). In the example shown in FIG. 5F, first aperture 522, second aperture 524, and third aperture 526 are generally circular in shape. However, other shapes may be provided, and the shape of any one aperture may be different than the other apertures. Moreover, the diameters of first aperture 522 and second aperture 524 (or the magnitude of some other characteristic dimension, if non-circular) are shown by way of example as being smaller than the diameter of third aperture 526. However, the diameters of first aperture 522 and second aperture 524 may be the same as or greater than the diameter of third aperture 526, or the respective diameters of first aperture 522 and second aperture 524 may be different from each other.

Figure 5G:
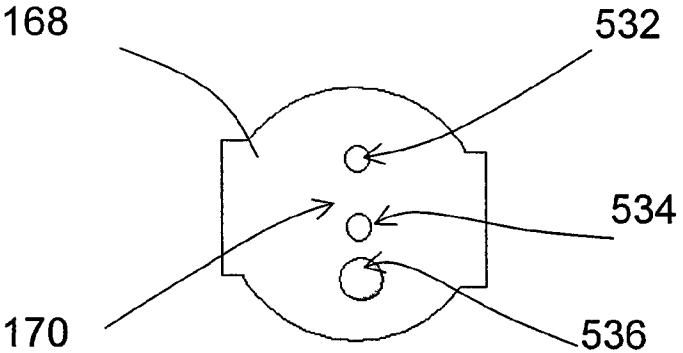

In FIG. 5G, similar to FIG. 5F, boundary opening 170 of front plate 168 is defined by three separate apertures, a first aperture 532, a second aperture 534, and a third aperture 536. First aperture 532 and second aperture 534 define the first passage 172 (FIGS. 1 and 4) for drying gas and third aperture 536 defines the second passage 174 for ions. Unlike FIG. 5F, first aperture 532 and second aperture 534 are spaced apart by a distance relative to third aperture 536, while second aperture 534 and third aperture 536 are spaced or grouped relatively close together. This configuration is another means by which the above-described elongated drying gas flow profile 180 (FIGS. 1 and 4) and its attendant benefits and advantages may be attained in accordance with the principles disclosed herein. In the example shown in FIG. 5G, first aperture 532, second aperture 534, and third aperture 536 are generally circular in shape. However, as in the case of FIG. 5F, other shapes may be provided, and the shape of any one aperture may be different than the other apertures. Moreover, the diameters of first aperture 532 and second aperture 534 (or the magnitude of some other characteristic dimension, if non-circular) are shown by way of example as being smaller than the diameter of third aperture 536. However, the diameters of first aperture 532 and second aperture 534 may be the same as or greater than the diameter of third aperture 536, or the respective diameters of first aperture 532 and second aperture 534 may be different from each other.

Figure 5H:
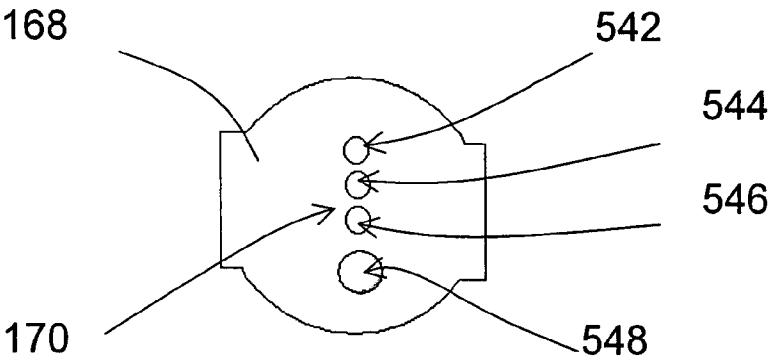

In FIG. 5H, boundary opening 170 of front plate 168 is defined by four separate apertures, a first aperture 542, a second aperture 544, a third aperture 546, and a fourth aperture 548. First aperture 542, second aperture 544, and third aperture 546 define the first passage 172 (FIGS. 1 and 4) for drying gas and fourth aperture 548 defines the second passage 174 for ions. The spacing between the apertures may be constant, or the spacing between any two adjacent apertures may be different than the spacing between any two other adjacent apertures. This configuration is yet another means by which the above-described elongated drying gas profile 180 (FIGS. 1 and 4) and its attendant benefits and advantages may be attained in accordance with the principles disclosed herein. In the example shown in FIG. 5H, first aperture 542, second aperture 544, third aperture 546, and fourth aperture 548 are generally circular in shape, but other shapes may be provided for one or more of these apertures 542, 544, 546 or 548. Moreover, the diameters of first aperture 542, second aperture 544, and third aperture 546 (or the magnitude of some other characteristic dimension if non-circular) are shown by way of example as being smaller than the diameter of fourth aperture 548. However, the diameters of first aperture 542, second aperture 544, and third aperture 546 may be the same as or greater than the diameter of fourth aperture 548, or the respective diameters of first aperture 542, second aperture 544, and third aperture 546 may be different from each other.

Figure 6:
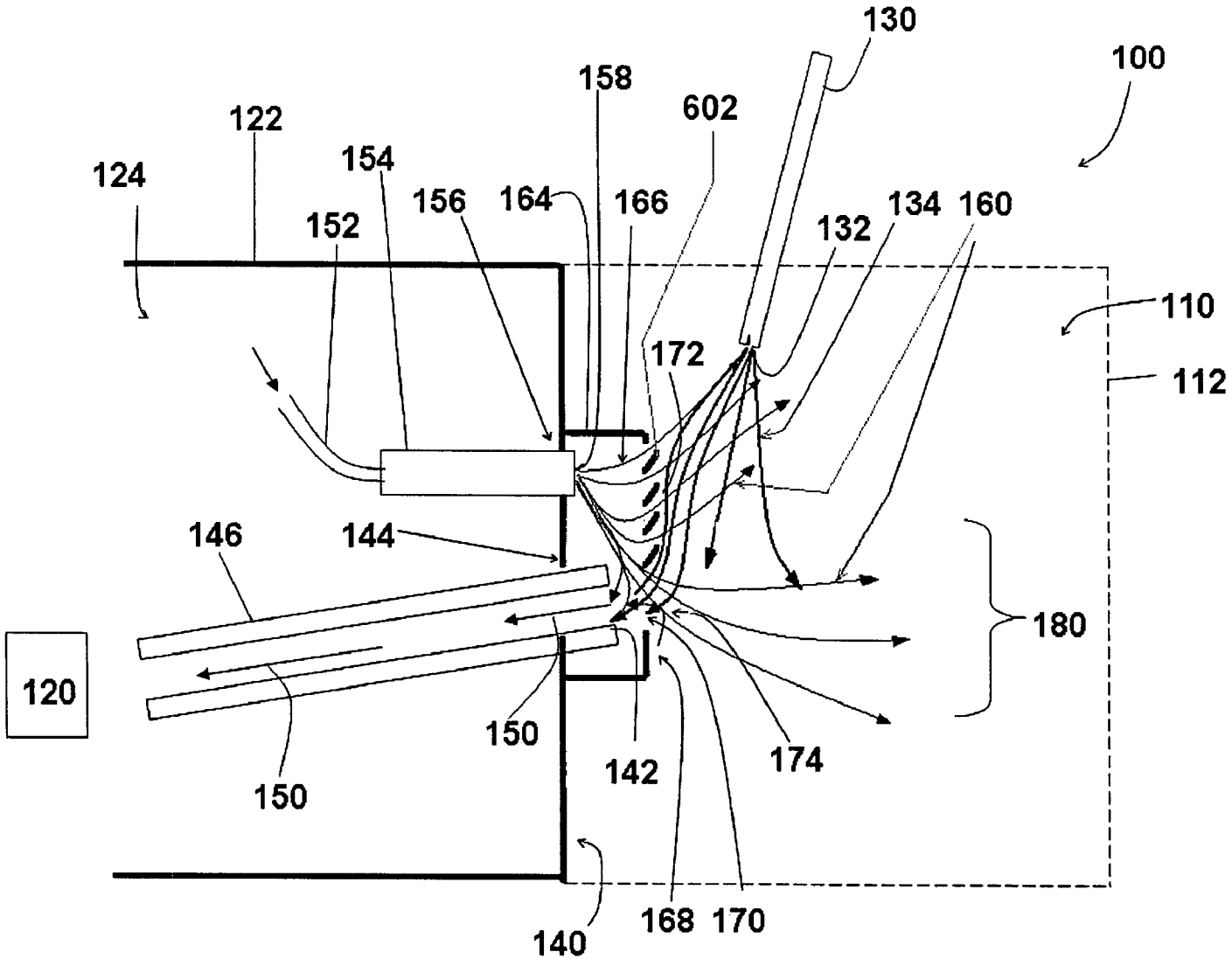
FIG. 6 is a schematic view of a cross-section of an apparatus for use in atmospheric pressure ionization (an API apparatus) according to another exemplary implementation.

In view of the foregoing description of various exemplary implementations, additional implementations for front plates 168 of both single-aperture and multi-aperture designs may be readily ascertained by persons skilled in the art. Such implementations may include boundary openings 170 for front plates 168 in which first passage 172 and/or second passage 174 (FIGS. 1, 4, and 6) are defined by one or more apertures having circular, slotted, tapered, or other shapes. All such implementations are characterized by their ability to produce an elongated flow profile 180 for drying gas stream 160 as schematically depicted in FIGS. 1, 4, and 6 and, consequently, an enlarged heating zone in an ion source such as an apparatus 100 for API and thus provide the advantages and benefits discussed above. In one particular implementation, the number of orifices or apertures is numerous enough that front plate 168 may be characterized as being structured as a mesh or screen. This implementation may have the effect of suspending the fissioning droplets at a distance in front of front plate 168 until a lower velocity zone in front of front plate 168 is encountered. Once the droplets encounter the lower velocity zone is encountered, the droplets pass through the apertures into interfacial space 166.

Referring now to FIG. 6, another exemplary implementation is illustrated in which boundary 164 (or front plate 168 if provided) has a multi-aperture design configured for directing drying gas stream 160 out from boundary opening 170 at more of an angle relative to the axis of sampling orifice 142. For this purpose, one or more apertures defined by boundary opening 170 are defined by one or more respective louvers or slats 602, such that each aperture may be characterized as having the shape of a slot defined between at least one louver 602 or pair of adjacent louvers 602. Any angle may be chosen for louvers 602 and may be selected in consideration of the general orientation of sample droplet stream 134 (or exit orifice 132 of sample droplet source 130). In the example illustrated in FIG. 6, given the orientation of sample droplet stream 134, louvers 602 are angled such that at least a portion of drying gas stream 160 and its elongated flow profile 180 are turned upward towards sample droplet stream 134. As a result, the enlarged heating zone is created by more of a counterflow or anti-parallel relation between sample droplet stream 134 and drying gas stream 160 as opposed to a cross-flow relation. This configuration may be found to be advantageous for certain fluid flow rates or other operating parameters. It will be noted that first passage 172 and/or second passage 174 may be defined by louvers 602, either partially or entirely. Moreover, louvers 602 may be utilized in combination with other types of apertures such as those described above. Still further, boundary 164 or front plate 168 may be configured so as to render louvers 602 movable to enable the angle of drying gas stream 160 to be adjusted.

With reference to the various implementations described above and illustrated in FIGS. 1–6, an example of a method for ionizing a sample utilizing a flow of drying gas will now be described. The method may employ an ion source adapted for atmospheric pressure ionization in accordance with any technique, such as ESI, APCI, or APPI, as briefly described previously and understood by persons skilled in the art. The method may, for example, utilize an apparatus 100 as described above and illustrated in FIG. 1 or 6 that is configured for producing an enlarged heating zone in an atmospheric or near-atmospheric pressure region in which sample material can encounter the drying gas of the heating zone so as to produce a stream or flux of ions for input to an analytical instrument such as a mass spectrometer 120. An example of mass spectrometer 120 is also briefly described previously and understood by persons skilled in the art. No limitation is placed on the type of mass spectrometer 120 or its associated components employed in the method. Mass spectrometer 120 may, for example, utilize any type, or combinations of more than one type, of mass sorting or filtering components, such as multipole electrode structures, ion traps, time-of-flight (TOF) components, electrostatic analyzers (ESAs), magnetic sectors, or the like. Mass spectrometer 120 may also, for example, utilize any type of ion detection means, such as an electron multiplier, photomultiplier, Faraday cup, or the like. The ion source utilized in the method may receive a direct input of a sample material, or may serve as an interface between mass spectrometer 120 and an upstream system such as an LC instrument.

In accordance with the method, and referring by way of example to FIG. 1 or 6, a sample material is processed by any suitable means that results in the introduction of a mass of sample droplets containing analytes and non-analytical components into chamber 110, such as by operating a sample droplet source 130 to emit a sample droplet stream 134. Depending on the technique employed, the droplets may or may not be electrically charged at the time they are emitted from exit orifice 132 of sample droplet source 130. As previously described, depending on the technique employed, sample droplet source 130 may comprise an electrospray needle, a vaporizer, and/or a nebulizer. Ionization of components of sample droplet stream 134 is initiated by any suitable technique, such as through the use of an electrospray needle (typically integrated with sample droplet source 130), a corona needle (not shown) positioned in chamber 110, a photon source (not shown) integrated with sample droplet source 130 or positioned in chamber 110, or the like. Sample droplet stream 134 is directed toward sampling orifice 142 by any suitable means, such as by aiming exit orifice 132 of sample droplet source 130 directly or indirectly (for example, in an angled or off-axis relation)

at sampling orifice 142, and/or through the use of a voltage potential established within chamber 110 for this purpose.

While sample droplet stream 134 flows through chamber 110, a drying gas stream 160 is introduced into chamber 110. The ion source (for example, apparatus 100) is structured to cause drying gas stream 160 to evolve into an elongated flow profile 180 in chamber 110, thereby providing an enlarged heating zone for enhancing evaporation of components of sample droplet stream 134. Elongated flow profile 180 may be positioned so that it crosses or contacts sample droplet stream 134 over a substantial portion of the path of sample droplet stream 134 from exit orifice 132 of sample droplet source 130 to sampling orifice 142, thereby optimizing the transfer of heat energy to components of sample droplet stream 134. As a result, an analyte ion stream 150 passes through sampling orifice 142 free or substantially free of unwanted components. From sampling orifice 142, the ions are guided by any suitable means to mass spectrometer 120 or other suitable instrument for analysis and detection.

In accordance with the method, elongated flow profile 180 may be established by practicing any of the implementations disclosed herein, including placing drying gas outlet orifice 158 in non-coaxial relation to sampling orifice 142 as illustrated in FIGS. 1, 2 and 6, and/or providing a boundary 164 having an opening 170 as illustrated in FIGS. 1, 3, 4, 5A, 5B, 5C, 5D, 5E, 5F, 5G, 5H, or 6. Opening 170 simultaneously allows the passage of drying gas in one direction and ions in a generally opposite direction by including structure that defines a first passage 172 and a second passage 174. Each passage 172 or 174 may be physically defined by one aperture or by more than one aperture. For these purposes, opening 170 may be defined by one or more structural features of boundary 164, such as front plate 168, as illustrated in FIGS. 1, 3, 4, 5A, 5B, 5C, 5D, 5E, 5F, 5G, 5H, or 6.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An apparatus for use in atmospheric pressure ionization, comprising:

a sample receiving chamber;

a sample droplet source communicating with the sample receiving chamber;

an outlet conduit defining a sampling orifice communicating with the sample receiving chamber; and a boundary interposed between the sample receiving chamber and the sampling orifice and comprising an opening, the opening defining a first passage through which a drying gas is flowable into the sample receiving chamber in an elongated flow profile and a second passage through which sample material is flowable from the sample receiving chamber toward the sampling orifice in generally counterflow relation to the drying gas, the first passage positioned in non-coaxial relation to the second passage.

2. The apparatus according to claim 1, comprising a housing enclosing an interior, wherein the sampling orifice provides fluid communication between the chamber and the interior.

3. The apparatus according to claim 1, comprising a drying gas exit orifice positioned on the same side of the boundary as the sampling orifice.

4. The apparatus according to claim 1, wherein the opening comprises a single aperture with the first and second passages.

5. The apparatus according to claim 4, wherein at least a portion of the opening defining the first passage is elongated in at least one dimension.

6. The apparatus according to claim 4, wherein the opening comprises a first section including the first passage and a second section including the second passage, the first section is elongated in at least a first dimension, and the second section adjoins the first section.

7. The apparatus according to claim 6, wherein the first section comprises a cross-section tapering along at least a portion of the first dimension.

8. The apparatus according to claim 1, wherein the opening comprises at least a first aperture and a separate second aperture, the first aperture defining the first passage and the second aperture defining the second passage.

9. The apparatus according to claim 8, wherein the first aperture is elongated in at least a first dimension relative to the second aperture.

10. The apparatus according to claim 1, wherein the opening comprises a plurality of separate apertures, one of the apertures defines the second passage, and the other apertures define the first passage.

11. The apparatus according to claim 1, wherein the boundary comprises a louver defining at least a portion of the opening.

12. An apparatus for use in atmospheric pressure ionization, comprising:

a sample receiving chamber;

a sample droplet source communicating with the sample receiving chamber;

an outlet conduit defining a sampling orifice communicating with the sample receiving chamber; and means for directing a flow of drying gas into the chamber according to an elongated flow profile and in a non-coaxial, generally counterflow relation to a flow of droplets from the sample droplet source.

13. The apparatus according to claim 12, wherein the directing means comprises a boundary interposed between the chamber and the sampling orifice, and the boundary includes an opening through which the drying gas is directed.

14. The apparatus according to claim 13, wherein the opening defines a first passage through which the drying gas is directed and a second passage through which ions from the droplets are admitted, and the first passage is positioned in non-coaxial relation to the second passage.

15. A method for evaporating droplets of sample material in an atmospheric pressure ionization apparatus, comprising:

admitting sample material into a chamber as a sample droplet stream;

directing the sample droplet stream toward an opening and a sampling orifice, wherein the chamber and sampling orifice are positioned at opposite sides of the opening and the sampling orifice leads away from the chamber; and while directing the sample droplet stream, admitting a flow of drying gas through the opening and into the chamber in a non-coaxial, generally counterflow relation to the sample droplet stream and according to an elongated flow profile, whereby the elongated flow profile presents an elongated area in which droplets of the sample droplet stream contact the drying gas for enhancing evaporation of the droplets prior to entry of sample material into the sampling orifice.

16. The method according to claim 15, comprising establishing the elongated flow profile by admitting the flow of drying gas through a portion of the opening that is elongated in at least one direction.

17. The method according to claim 15, wherein the opening comprises a plurality of apertures, directing the sample droplet stream toward the opening comprises directing the sample droplet stream toward at least one of the apertures, and admitting the flow of drying gas into the chamber comprises admitting the flow of drying gas through at least one other aperture.

18. The method according to claim 17, comprising establishing the elongated flow profile by admitting the flow of drying gas through the at least one aperture of the opening that is elongated in at least one direction.

* * * * *